US011375873B2

(12) United States Patent
Ryu et al.

(10) Patent No.: US 11,375,873 B2
(45) Date of Patent: Jul. 5, 2022

(54) AIR BLOWER AND DISH WASHER HAVING THE SAME

(71) Applicant: SAMSUNG ELECTRONICS CO., LTD., Suwon-si (KR)

(72) Inventors: Jung-chan Ryu, Yongin-si (KR); Jae-woo Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/019,525

(22) Filed: Sep. 14, 2020

(65) Prior Publication Data

US 2020/0405123 A1 Dec. 31, 2020

Related U.S. Application Data

(62) Division of application No. 15/364,957, filed on Nov. 30, 2016, now abandoned.

(30) Foreign Application Priority Data

Nov. 30, 2015 (KR) ..... 10-2015-0168759

(51) Int. Cl.
*A47L 15/48* (2006.01)
*E05F 15/70* (2015.01)

(52) U.S. Cl.
CPC ..... *A47L 15/486* (2013.01); *E05F 15/70* (2015.01); *E05Y 2201/426* (2013.01); *E05Y 2900/304* (2013.01)

(58) Field of Classification Search
CPC .. A47L 15/486; A47L 15/488; A47L 15/0013; A47L 15/4261; E05F 15/70
USPC ..... 312/228, 311, 326; 134/56 D
See application file for complete search history.

(56) References Cited

U.S. PATENT DOCUMENTS 4,657,036 A * 4/1987 Yake ..... A47L 15/4217 134/115 R
5,660,195 A 8/1997 Taylor, Jr.
5,881,746 A 3/1999 Buser
7,731,806 B2 6/2010 Hapke
8,313,583 B2 11/2012 May
8,671,587 B2 3/2014 Berends et al.
8,758,525 B2 6/2014 Kim
(Continued)

FOREIGN PATENT DOCUMENTS

KR 1996-0002224 3/1996
KR 0147903 5/1997
(Continued)

OTHER PUBLICATIONS

Korean Office Action dated Jul. 16, 2019 in corresponding Korean Patent Application No. 10-2015-0168759.
(Continued)

*Primary Examiner* — James O Hansen
(74) *Attorney, Agent, or Firm* — Staas & Halsey LLP

(57) ABSTRACT

A dish washer capable of effectively decreasing a dry time is provided. The dish washer includes a body; a wash tank provided in the body in order to wash dishes therein; a door rotatably coupled to the body to open and close the wash tank; an air blower spraying out air jet from a front surface of the body to the front of the body so as to allow wet steam in the wash tank to forcedly flow to the front when the door is opened.

15 Claims, 10 Drawing Sheets

(56) References Cited

U.S. PATENT DOCUMENTS

| | | | | |
|---|---|---|---|---|
| 8,905,494 | B2 | 12/2014 | Kilic | |
| 9,750,392 | B2 * | 9/2017 | Bewley, Jr. et al. .. | A47L 15/488 454/49 |
| 2006/0231122 | A1 | 10/2006 | Stelzer | |
| 2010/0043250 | A1 | 2/2010 | Berends et al. | |
| 2010/0300499 | A1 * | 12/2010 | Han ..... | A47L 15/483 134/172 |
| 2011/0036383 | A1 | 2/2011 | Tiekoetter | |
| 2011/0126864 | A1 * | 6/2011 | Kim ..... | A47L 15/483 134/25.2 |
| 2011/0279004 | A1 | 11/2011 | Assmann | |
| 2012/0055519 | A1 * | 3/2012 | Hong ..... | B01D 53/261 134/107 |
| 2013/0008474 | A1 | 1/2013 | Thayyullathil | |
| 2013/0180553 | A1 | 7/2013 | Gaus | |
| 2014/0223761 | A1 | 8/2014 | Lee | |
| 2014/0238450 | A1 | 8/2014 | Bertram | |
| 2015/0068056 | A1 * | 3/2015 | Jung ..... | A47L 15/488 34/218 |
| 2015/0245760 | A1 | 9/2015 | Bewley, Jr. | |

FOREIGN PATENT DOCUMENTS

| | | |
|---|---|---|
| KR | 10-2007-0105056 | 10/2007 |
| KR | 10-1017596 | 2/2011 |
| KR | 10-1202103 | 11/2012 |

OTHER PUBLICATIONS

U.S. Office Action dated Jul. 17, 2020 from U.S. Appl. No. 15/364,957.
U.S. Office Action dated Jun. 22, 2017 from U.S. Appl. No. 15/364,957.
U.S. Office Action dated Oct. 24, 2017 from U.S. Appl. No. 15/364,957.
U.S. Office Action dated May 24, 2018 from U.S. Appl. No. 15/364,957.
U.S. Advisory Action dated Jul. 26, 2018 from U.S. Appl. No. 15/364,957.
U.S. Office Action dated Aug. 24, 2018 from U.S. Appl. No. 15/364,957.
U.S. Office Action dated Mar. 15, 2019 from U.S. Appl. No. 15/364,957.
U.S. Office Action dated Jun. 10, 2019 from U.S. Appl. No. 15/364,957.
U.S. Office Action dated Dec. 9, 2019 from U.S. Appl. No. 15/364,957.
U.S. Advisory Action dated Feb. 13, 2020 from U.S. Appl. No. 15/364,957.
U.S. Office Action dated Mar. 25, 2020 from U.S. Appl. No. 15/364,957.
U.S. Appl. No. 15/364,957, filed Nov. 30, 2016, Jung-chan RYU, Samsung Electronics Co., Ltd.

* cited by examiner

AIR BLOWER AND DISH WASHER HAVING THE SAME

CROSS-REFERENCE TO RELATED APPLICATIONS

This application is a divisional application of U.S. Ser. No. 15/364,957, filed on Nov. 30, 2016. In the United States Patent and Trademark Office and claims priority from Korean Patent Application No. 10-2015-0168759, filed on Nov. 30, 2015, in the Korean Intellectual Property Office, the disclosures of each of which are incorporated herein by reference in their entirety.

BACKGROUND OF THE INVENTION

Field of the Invention

Apparatuses and methods consistent with the present disclosure relate to an air blower and a dish washer having the same, and more particularly, to an air blower capable of controlling a flow direction of steam discharged from the inside of a dish washer, and the dish washer having the same.

Description of the Related Art

A dish washer is an apparatus injecting high-pressure wash water to dishes to wash the dishes. Generally, in the dish washer, a pre-wash step, a main wash step, a rinse step, and a dry step are performed. In the pre-wash step, leavings on the dishes are removed by injecting wash water without injecting a detergent. In the main wash step, the dishes are washed by allowing the detergent to be injected by a detergent supply device while injecting the wash water.

The dish washer is configured to include a body in which a wash tank is provided, a basket installed to so as to be movable forward and rearward in the wash tank while accommodating dishes, an injection nozzle provided at upper and lower portions of the basket to inject wash water, and the like, and the wash water injected from the injection nozzle may wash the dishes.

In a dish washer according to the related art, after washing dishes using hot water, latent heat remaining in the dishes, and the like, due to the hot water radiates outside the dishes. Water remaining on a surface of the dish is evaporated by the latent heat, such that the dish is dried, or the dish is dried by injecting hot air to the dish using a separate heater.

In the case of using latent heat at the time of drying the dishes as described above, it took a long time to dry the dishes, such that drying efficiency was significantly decreased, and a drying state was not good. Further, in the case of drying the dish by supplying hot air using the separate heater, there was a problem in that a large amount of energy was consumed, such that an electric charge was expensive.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present disclosure provides an air blower capable of decreasing a dry time of a dish washer.

In addition, the present disclosure provides an air blower capable of controlling a flow direction of hot steam discharged from the inside of a dish washer, and a dish washer having the same.

According to an aspect of the present disclosure, a dish washer includes: a body; a wash tank provided in the body in order to wash dishes therein; a door rotatably coupled to the body to open and close the wash tank; an air blower spraying out air jet from a front surface of the body to the front of the body so as to allow wet steam in the wash tank to forcedly flow to the front when the door is opened.

The air jet may be sprayed out at a speed faster than a natural discharge speed of air in the wash tank.

The air blower may include: a blower duct installed between the outside of the wash tank and the inside of the body and having an outlet facing the front surface of the body; and a blower fan communicating with the blower duct to supply external air to the outlet through the blower duct.

The blower fan may be provided between the outside of the wash tank and the inside of the body to thereby be positioned at one side surface of the body.

The body may have a communication hole communicating with the outside in one side surface, and the blower fan may suck external air from the communication hole to discharge the sucked air to the blower duct.

The blower fan may be any one of a centrifugal fan, an axial flow fan, and a cross flow fan.

The dish washer may further include an automatic door opening device automatically opening the door after a wash process is terminated, wherein the automatic door opening device is positioned between an upper portion of the wash tank and the body, and the outlet is positioned at both sides of the automatic door opening device, respectively.

A partition wall partitioning the outlet into a plurality of regions may be provided in the blower duct.

The blower duct may include: a main channel communicating with the blower fan and positioned in parallel with a width direction of the door; a first channel branched from the main channel and communicating with a first outlet positioned at one side of an automatic door opening device; and a second channel branched from the main channel and communicating with a second outlet positioned at the other side of the automatic door opening device.

The blower fan may be positioned to be closer to the first channel than the second channel, and the main channel may have a rear surface positioned to be inclined downward so that the second channel is close to the front.

The blower duct may further include a channel guide wall installed in each of the channels to guide a flow of the air flowing through the blower fan.

The channel guide wall may include: a first channel guide wall installed in the main channel to be positioned in parallel with the rear surface of the blower duct; and a second channel guide wall installed in the first channel and positioned to be perpendicular to the first channel guide wall.

The channel guide wall may further include a third channel guide wall installed in a boundary between the main channel and the second channel or the inside of the second channel and positioned to be parallel with the second channel guide wall.

The dish washer may further include an automatic door opening device automatically opening the door after a wash process is terminated, wherein the automatic door opening device is positioned between an upper portion of the wash tank and the body, and the blower duct is positioned above the automatic door opening device.

The blower duct may have a channel in which air flows, wherein the channel is provided to be inclined upwardly toward the outlet.

The air blower may be installed in plural, and each of the air blowers may be positioned between an upper portion of the wash tank and the body.

According to another aspect of the present disclosure, an air blower blowing wet steam discharged between a body and a door of dish washer when a wash process of the dish washer is terminated and the door is opened by an automatic door opening device, includes: a blower duct positioned at an upper portion of the body and having an outlet so as to face a front surface of the body; and a blower fan communicating with the blower duct to allow air to flow to the blower duct.

A partition wall partitioning the outlet into a plurality of regions may be provided in the blower duct.

The blower duct may include: a main channel communicating with the blower fan and positioned in parallel with a width direction of the door; a first channel branched from the main channel and communicating with a first outlet positioned at one side of an automatic door opening device; and a second channel branched from the main channel and communicating with a second outlet positioned at the other side of the automatic door opening device.

The blower duct may further include a channel guide wall installed in each of the channels to guide a flow of air flowing through the blower fan.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
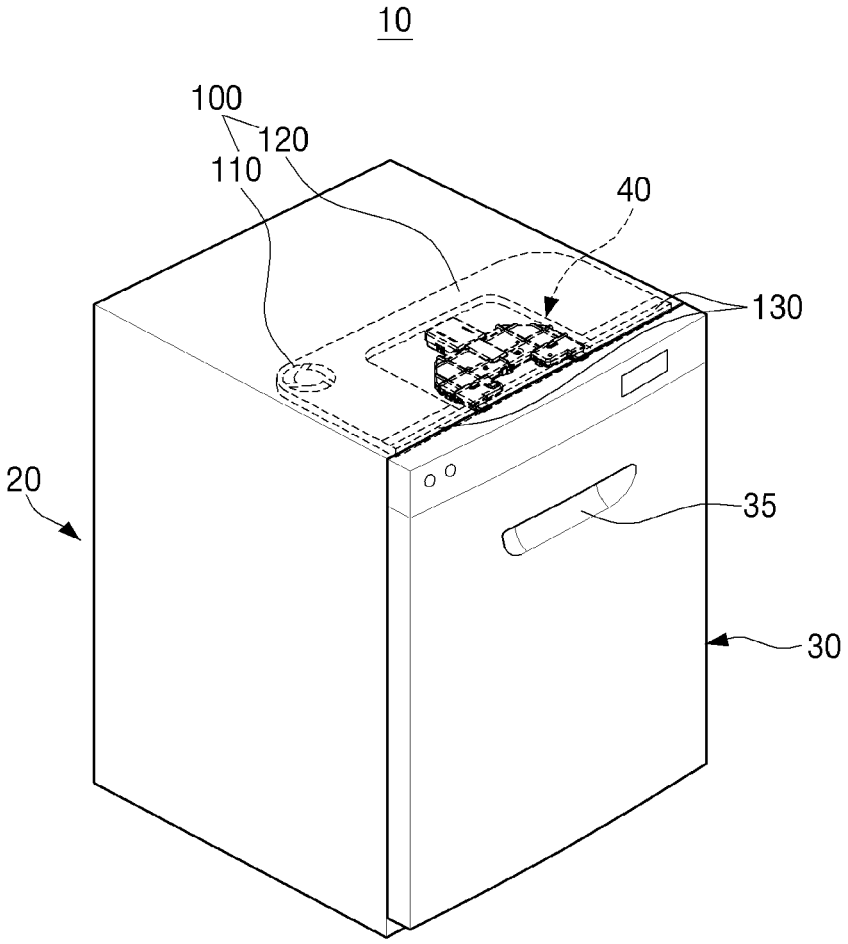
FIG. 1 is a perspective view schematically illustrating a dish washer according to an exemplary embodiment of the present disclosure.

Hereinafter, exemplary embodiments of the present disclosure will be described in more detail with reference to FIGS. 1 to 10. The exemplary embodiments described below will be described on the basis of exemplary embodiments most suitable for understanding technical features of the present disclosure, but the technical features of the present disclosure are not limited by the exemplary embodiment to be described. That is, the present disclosure may be implemented as the exemplary embodiment described below.

Therefore, the present disclosure may be variously modified within the technical scope of the present disclosure through the following exemplary embodiments, and these modified exemplary embodiments are also included in the scope of the present disclosure. Further, in order help the understanding of the exemplary embodiments described below, among components having the same action as each other, related components are denoted by the same or similar reference numerals.

Hereinafter, a configuration of a dish washer according to an exemplary embodiment of the present disclosure will be described with reference to the accompanying drawings. Although a built-in type dish washer built in a separated installation space between furniture or walls is described by way of example of the dish washer according to the present disclosure, the present disclosure may be applied to a free-standing type dish washer which is not built-in but is independently used.

FIG. 1 is a perspective view schematically illustrating the dish washer according to an exemplary embodiment of the present disclosure. Referring to FIG. 1, the dish washer 10 includes a body 20 form an exterior thereof, a wash tank (or tub) (not illustrated) provided in the body 20, a door 30 rotatably installed on a front surface of the body 20, an automatic door opening device 40 installed at an upper portion of the door 30, and an air blower 100 spraying air-jet when the door 30 is opened.

Although not illustrated, dishes are accommodated in the wash tank, such that a wash space of the dishes is formed. The wash tank has a substantially box shape in which an opening is formed in the front thereof so as to accommodate the dishes. Further, the wash tank may be configured to include a sump formed in a lower portion thereof so that wash water is stored therein.

The wash tank may be provided with an accommodation part of which an upper portion is opened so that the dishes are accommodated therein, and a dish basket may be installed so as to be movable forward and rearward in upper and lower portion of the wash tank. The dish basket may be drawn out and accommodated through the front surface of the body 20 opened by at least one rack supporting the dish basket so as to be slidably movable.

At least one nozzle injecting the wash water to the dishes accommodated in the wash tank is disposed in the body 20. Further, the automatic door opening device 40 is embedded in an upper portion of the body 20. In this case, a front end portion of the automatic door opening device 40 may be positioned to be adjacent to the opening so that the automatic door opening device 40 opens the door 30.

The opening of the wash tank may be opened and closed by the door 30. As an example, the door 30 is hinge-coupled to a lower portion of the front surface of the body 20 to rotate, thereby making it possible to open and close the wash tank. In this case, a handle groove 35 may be formed in an outer portion of the door 30 so that the door 30 may be manually opened.

The automatic door opening device 40 may automatically open the door 30 by a preset angle in order to maintain the inside of the wash tank in a dried state by discharging the steam in the body to the outside when the wash process is completed.

The air blower 100 includes a blower duct 120 installed in the upper portion of the body 20 and having an outlet 130 spraying air jet so that the steam discharged to the outside flows to the front of the body 20 and a blower fan 110 providing a flow of air to the blower duct 120. Hereinafter, a structure of the air blower 100 will be described in detail.

Figure 2:
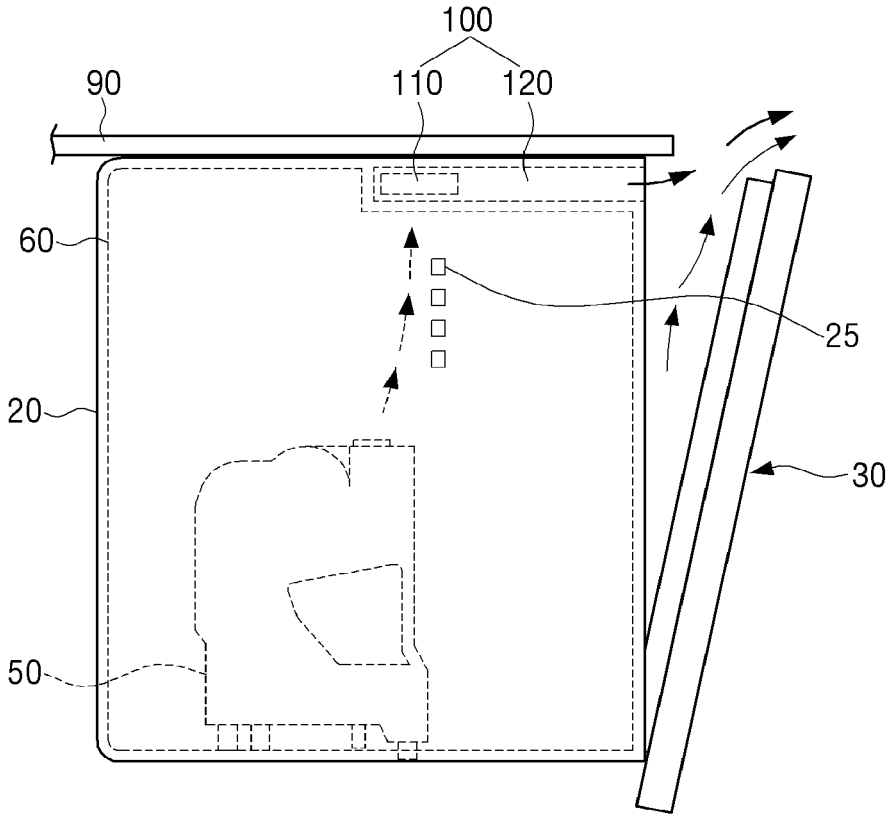
FIG. 2 is a side view of the dish washer according to the exemplary embodiment of the present disclosure.
Figure 3:
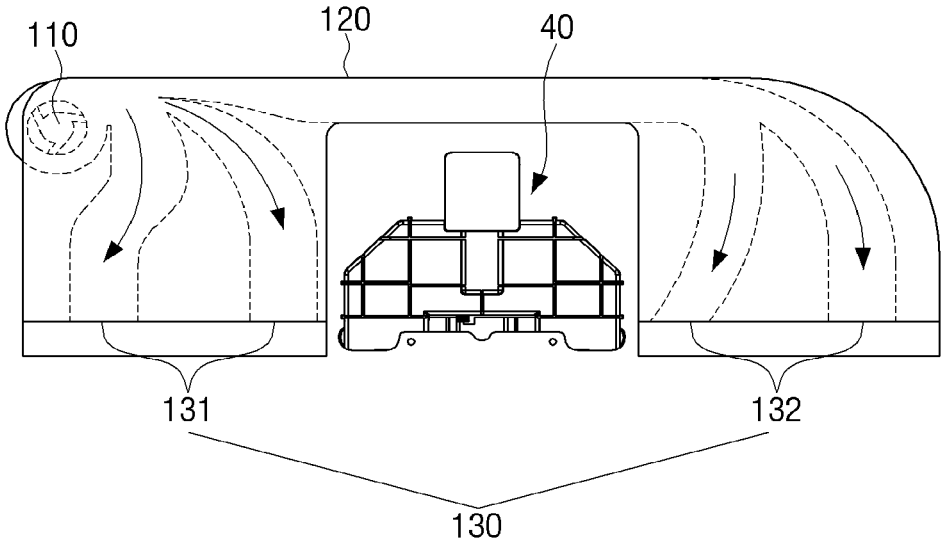
FIG. 3 is a view illustrating an air blower according to a first exemplary embodiment of the present disclosure.

FIG. 2 is a side view of the dish washer according to the exemplary embodiment of the present disclosure, and FIG. 3 is a view illustrating an air blower according to a first exemplary embodiment of the present disclosure. Referring to FIGS. 2 and 3, the blower duct 120 may be embedded in a space part between the upper portion of the wash tank 60 and the body 20. The blower fan 110 is installed between the body 20 and the wash tank 60 and positioned to be adjacent to one side surface of the body 20.

As an example, an air brake 50 may be installed on one side surface of the body 20. A hole (not illustrated) communicating with the wash tank 60 in order to introduce air into the wash tank 60 or discharge the air from the wash tank 60 may be installed in the air brake 50.

The blower fan 110 may be installed above the air brake. A communication hole 25 communicating the outside and the body 20 may be installed in the body 20, and the communication hole 25 may be positioned between the blower fan 110 and the air brake 50. The blower fan 110 may be a centrifugal fan for supplying air introduced from the outside to the blower duct 120.

In the case of using the centrifugal fan as the blower fan 110, the blower fan 110 may suck external air introduced through the communication hole 25 to supply the sucked air to the blower duct 120. Further, since the blower fan 110 may suck and discharge high-temperature and high-humidity steam in the wash tank 60 together, discharged through the air brake 50, there is an advantage in that moisture in the air brake 50 may be easily removed.

In addition, since a space between the body 20 and the wash tank 60 having a substantially box shape may be minimized, it is possible to improve space use efficiency. Further, a preset flow rate of air may be maintained by effectively supplying the air supplied to the inside of the blower duct 120.

Particularly, in the case in which the blower fan 110 is installed in one side, there is an advantage in that since the blower fan 110 uses the same power source as that of a driving part driving the automatic door opening device 40, there is no need to provide a separate power supply device.

The blower fan 110 is not limited to the centrifugal fan, and it is possible to flow air to the blower duct 120 using an axial flow fan, a cross flow fan, or the like, so as to be positioned in corner portions of the body 20 and the wash tank 60.

The blower duct 120 is positioned at one side of the blower fan, and the air sucked through the blower fan 110 is introduced into the blower duct 120. The blower duct 120 has the outlet 130 so as to inject the air supplied through the blower fan 110 to the front. The blower duct 120 may be installed at a position substantially parallel with the automatic door opening device 40. In this case, the outlet 130 may be positioned at both sides based on the automatic door opening device 40.

A rear surface of the blower duct 120 may be positioned to be substantially parallel in a width direction of a door, and the blower fan 110 may be accommodated in one side in the rear of the air duct 120 so as to communicate with the inside of the blower duct 120. An outlet positioned at one side is referred to as a first outlet 131, and an outlet positioned at the other side is referred to as a second outlet 132.

Meanwhile, the first outlet 131 may be formed in plural, and the second outlet 132 may also be formed in plural. Each of the outlets 130 may be additionally formed in the width direction of the door so that the steam discharged upwardly by the opening of the door 40 may be sprayed out to the front, and the numbers of blower ducts 120 and outlets 130 are not limited. In addition, the outlet may be disposed to be upwardly inclined so that a direction of the steam may be easily changed in the wash tank by the opening of the door.

Figure 4:
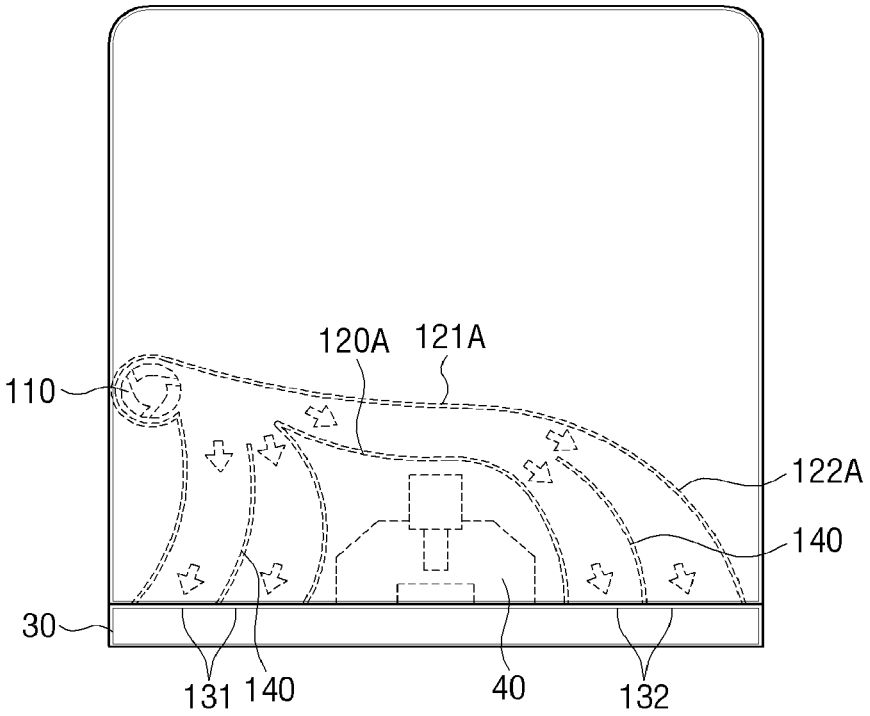
FIG. 4 illustrates a modified example of the air blower illustrated in FIG. 3.

FIG. 4 illustrates a modified example of the air blower illustrated in FIG. 3. Hereinafter, in describing the modified examples, a difference with the air blower 100 described with reference FIGS. 1 to 3 will be mainly described below, and an omitted description may be replaced with the description described above.

Referring to FIG. 4, a partition wall 140 may be installed in a blower duct 120A, and provide a channel so that air introduced into the blower duct 120A may flow therein. Further, the partition wall 140 may partition the inside of the blower duct 120A, and in the case in which the partition wall 140 is extended to each of the first outlets 131 and second outlet 132, the partition wall may partition the first outlets 131 and second outlet 132 into a plural of regions.

A front surface 121A of the blower duct 120A may have a shape inclined downwardly toward the second outlet 132 so that air flowing from the blower fan 110 may smoothly flow. Further, a side surface 122A of the blower duct 120A may have a smooth curved surface toward the second outlet 132. In addition, the partition wall 140 may have a shape corresponding to the side surface of the blower duct 120 so as to partition the first outlet 131. The partition wall 140 may be additionally installed so as to partition the second outlet 132, and each of the partition walls 140 may be changed depending on a shape of the blower duct 120A.

Figure 5:
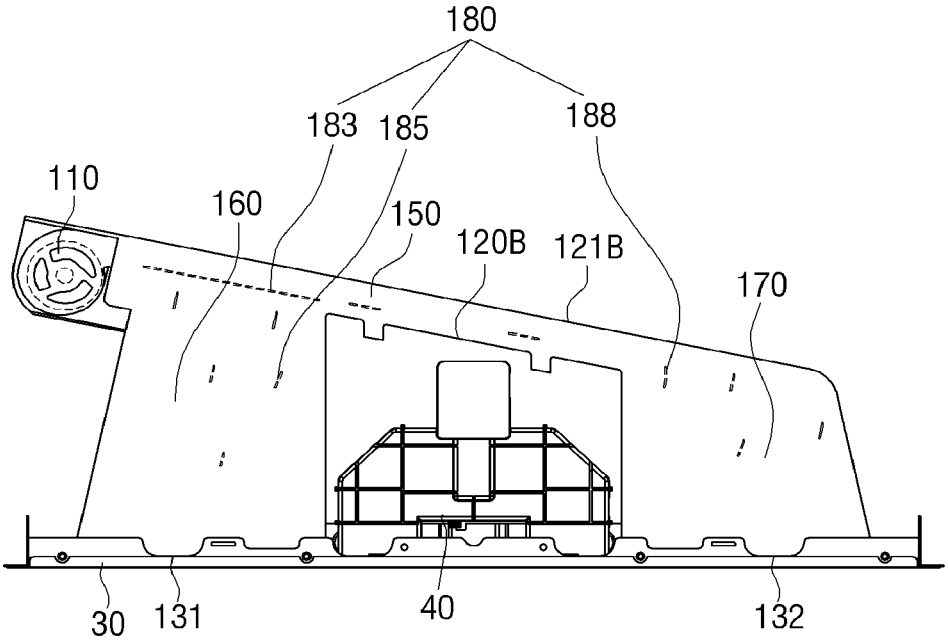
FIG. 5 illustrates another modified example of the air blower illustrated in FIG. 3.

FIG. 5 illustrates another modified example of the air blower illustrated in FIG. 3. Referring to FIG. 5, a blower duct 120B may have a rear surface 121B disposed to be inclined downwardly toward the second outlet 132. In this case, the blower duct 120B may have a main channel 150 communicating with the blower fan 110 to be disposed in parallel in the width direction of the door and first and second channels 160 and 170 branched from the main channel 150, respectively. In this case, the main channel 150 may have a shape inclined downwardly toward the second outlet 132 so as to correspond to the rear surface 121B of the blower duct 120B.

The first channel 160 communicates with the first outlet 131 and disposed at one side of the automatic door opening device 40. The second channel 170 communicates with the second outlet 132 and disposed at the other side of the automatic door opening device 40. In this case, the blower fan 110 is positioned adjacently to the first channel 160, and cross-sectional areas of the first and second outlets 131 and 132 may be the same as each other. Meanwhile, since the second channel 170 has the shape inclined downwardly toward the second outlet 132, a cross-sectional area of the first channel 160 may be larger than that of the second channel 170.

A channel guide wall 180 may be formed in each of the channels. The channel guide wall 180 may guide the flow of the air flowing through the blower fan 110. A first channel guide wall 183 may be installed in the main channel 150 to thereby be positioned in parallel with the rear surface 121B of the blower duct 120B. The first channel guide wall 183 may be installed in plural.

As an example, a first channel guide wall 183 positioned to be close to the blower fan 110 may have a length longer than that of a first channel guide wall 183 positioned to be distant from the blower fan 110. The first channel guide wall 183 positioned to be close to the blower fan 110 may have a longer length to guide the air so as to easily flow the air to the second channel 170, thereby making it possible to uniformly discharge the air sprayed toward the first and second outlets 131 and 132.

A second channel guide wall 185 may be installed in the first channel 160 and positioned to be substantially perpendicular to the first channel guide wall 183. The second channel guide wall 185 may be installed in plural, and positioned to have different phase differences from each other in the first channel 160 so that the air flowing to the first outlet 131 may smoothly flow.

A third channel guide wall 188 may be installed at least one or more spaces of a boundary between the main channel 150 and the second channel 170 and the inside of the second channel 170, and positioned to be substantially parallel with the second channel guide wall 185. Similarly to the second channel guide wall 185, the third channel guide wall 188 may be positioned in the second channel 170 or the boundary between the main channel 150 and the second channel 170 to have a different phase difference so that the air flows to the second channel 170 may smoothly flows to the second outlet 132.

Figure 6:
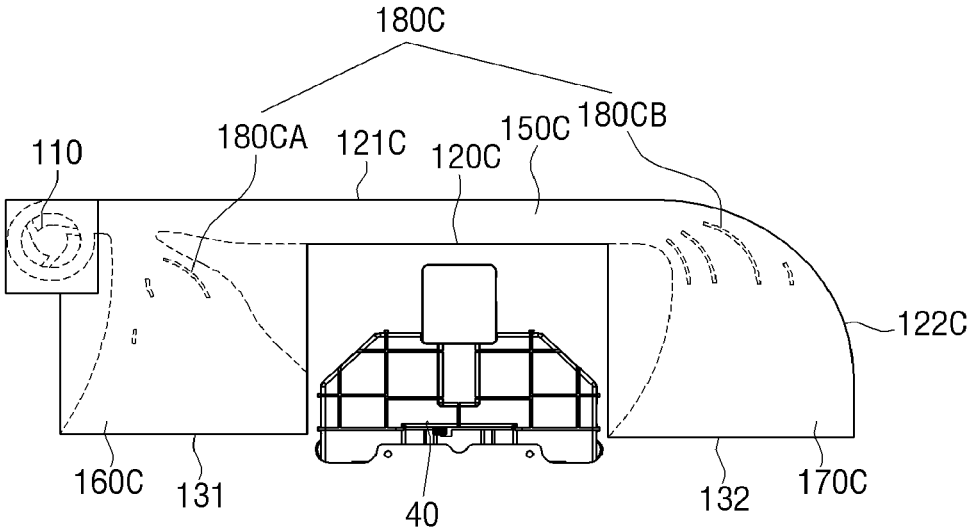
FIG. 6 illustrates still another modified example of the air blower illustrated in FIG. 3.

FIG. 6 illustrates still another modified example of the air blower illustrated in FIG. 3. Referring to FIG. 6, the other side surface 122C and a rear surface 121C of a blower duct 120C positioned in the rear of the second outlet 132 may have an arc shape. In order to guide the flow of the air flowing through the blower fan 110, a channel guide wall 180C may be formed in the blower duct 120C.

In the case in which the rear surface 121C of the blower duct 120C is substantially parallel with the rear surface of the body 20, the channel guide wall 180C may be installed in a first channel 160C and a boundary between a first main channel 150C and a second channel 170C, respectively.

In this case, a first channel guide wall 180CA installed in the first channel 160C may have a predetermined radius of curvature in the first channel 160 so that the air flowing to the first outlet 131 may smoothly flow. A second channel guide wall 180CB installed in the boundary between the main channel 150C and the second channel 170C may be installed to have a predetermined radius of curvature so as to corresponding to the arc shape of the blower duct 120C. The second channel guide wall 180CB may be positioned to be spaced apart from the second outlet 132 in the width direction of the door so that uniform air may be sprayed to the front.

Figure 7:
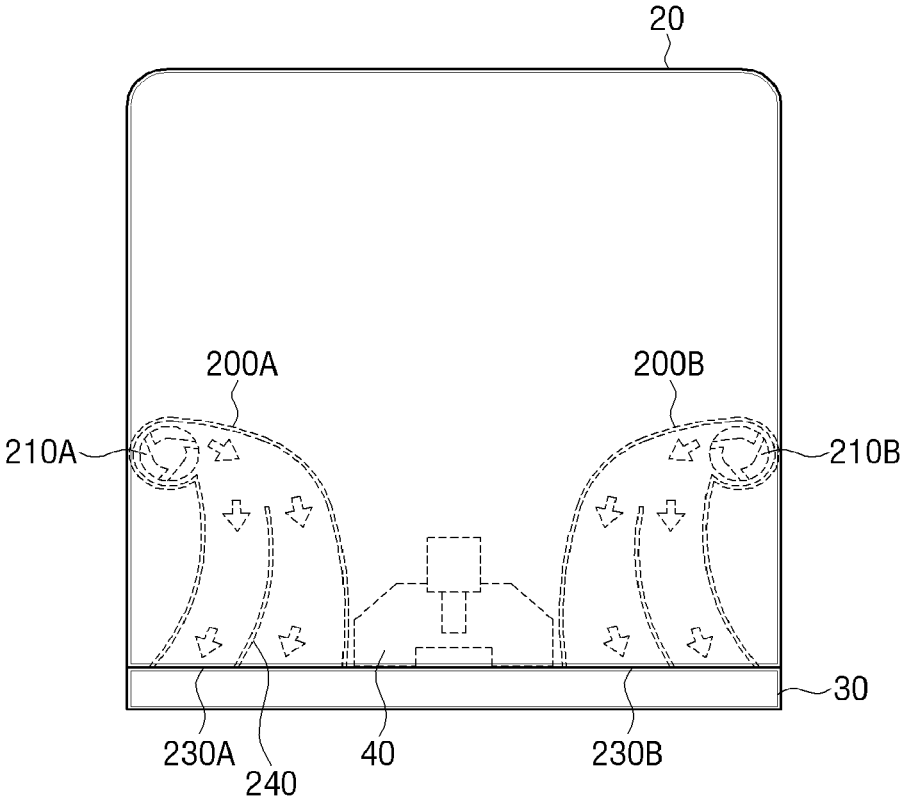
FIG. 7 is a view illustrating an air blower according to a second exemplary embodiment of the present disclosure.

FIG. 7 is a view illustrating an air blower according to a second exemplary embodiment of the present disclosure. Referring to FIG. 7, first and second blower ducts 200A and 200B may be embedded in a space part between an upper portion of a wash tank 60 and a body 20. The first and second blower ducts 200A and 200B may be installed at both sides based on an automatic door opening device 40. In this case, first and second blower fans 210A and 210B are installed between the body 20 and the wash tank 60 and positioned to be adjacent to one side surface and the other side surface of the body 20, respectively.

The first and second blower fans 210A and 210B may be centrifugal fans for supplying air introduced from the outside to the first and second blower ducts 200A and 200B. The first and second blower ducts 200A and 200B may be positioned to one sides of the first and second blower fans 210A and 210B, respectively, and airs sucked through the first and second blower fans 210A and 210B is introduced into the first and second blower ducts 200A and 200B, respectively.

The first and second blower ducts 200A and 200B have first and second outlets 230A and 230B, respectively, so as to inject the air supplied through the first and second blower fans 210A and 210B to the front. The first and second blower ducts 200A and 200B may be installed at positions approximately parallel with the automatic door opening device 40. In this case, the first and second outlets 230A and 230B may be positioned at both sides based on the automatic door opening device 40, respectively.

The first and second blower fans 210A and 210B are positioned at both sides of the automatic door opening device 40, respectively, such that steam discharged from the inside of the wash tank 60 may be effectively dispersed to the front through strong air flows.

In this case, the first and second blower fans 210A and 210B may be positioned at one side in the rear of the first and second blower ducts 200A and 200B so as to communicate with the insides of the first and second blower ducts 200A and 200B, respectively. Rear surfaces of the first and second blower ducts 200A and 200B may have a shape with a radius of curvature toward the front so as to minimize air resistance, and a partition wall 240 capable of partitioning the inside may be installed in each of the first and second blower ducts 200A and 200B. In the case in which the partition wall 240 is installed toward the first and second outlets 230A and 230B, the first and second outlets 230A and 230B may be divided into a plurality of outlets 230A and 230B, respectively.

The first outlet 230A may be formed in plural, and the second outlet 230B may also be formed in plural. Each of the first and second outlets 230A and 230B may be additionally formed in a width direction of the door so that steam discharged upwardly by the opening of the door 30 may be sprayed to the front, and the numbers of first and second blower ducts 200A and 200B and first and second outlets 230A and 230B are not limited.

Figure 8:
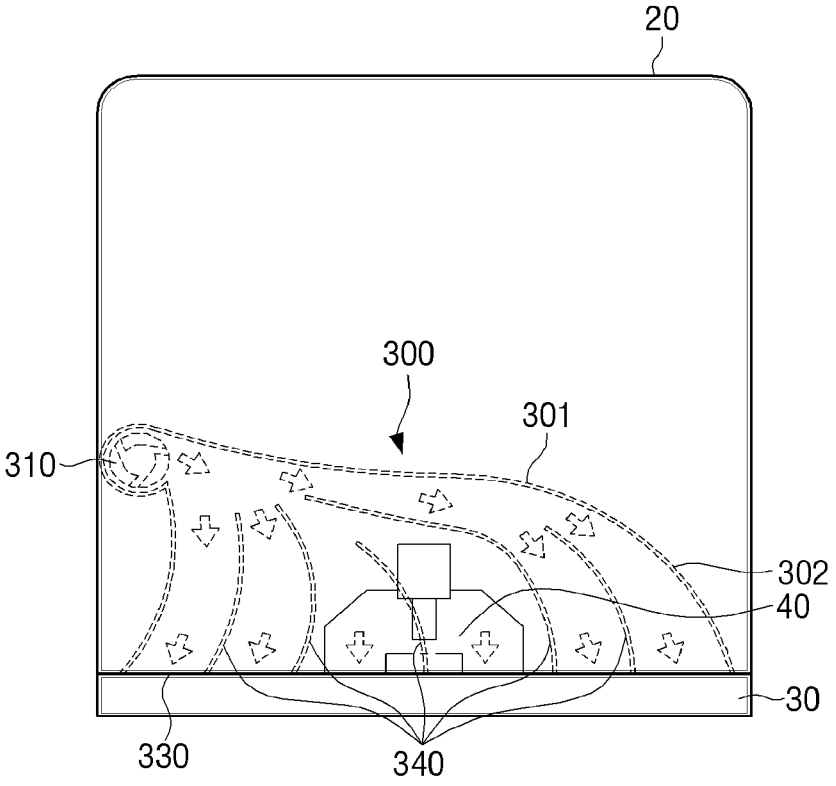
FIG. 8 is a view illustrating an air blower according to a third exemplary embodiment of the present disclosure.

FIG. 8 is a view illustrating an air blower according to a third exemplary embodiment of the present disclosure. Referring to FIG. 8, a blower duct 300 may be embedded in a space part between an upper portion of a wash tank 60 and a body 20. The blower duct 300 may be positioned above an automatic door opening device 40. In this case, a blower fan 310 is installed between the body 20 and the wash tank 60 and positioned to be adjacent to one side surface of the body 20.

The blower fan 310 may be a centrifugal fan for supplying air introduced from the outside to the blower duct 300. The blower duct 300 is positioned at one side of the blower fan 310, and the air sucked through the blower fan 310 is introduced into the blower duct 300. The blower duct 300 has an outlet 330 so as to inject the air supplied through the blower fan 310 to the front. The blower duct 300 may be installed at a position approximately parallel with the automatic door opening device 40. In this case, the outlet 330 may be positioned at both sides based on the automatic door opening device 40.

A plurality of partition walls 340 may be installed in the blower duct 300, and provide a plurality of channels so that air introduced into the blower duct 300 may flow therein. Further, the plurality of partition walls 340 may partition the inside of the blower duct 300, and in the case in which the partition walls 340 is extended to the outlet 330, the partition walls 340 may partition the outlet 330 into a plural of regions.

A rear surface 301 of the blower duct 300 may be positioned so as to be closer to the front in a direction opposite to the blower fan 310 in order to allow air flowing from the blower fan 310 to smoothly flow. Further, a side surface 302 of the blower duct 300 may have a smooth curved surface toward the outlets 330. In addition, the partition walls 340 may have a shape corresponding to the side surface 302 so as to partition the outlet 330, and each of the partition walls 340 may be changed depending on a shape of the blower duct 300.

Figure 9:
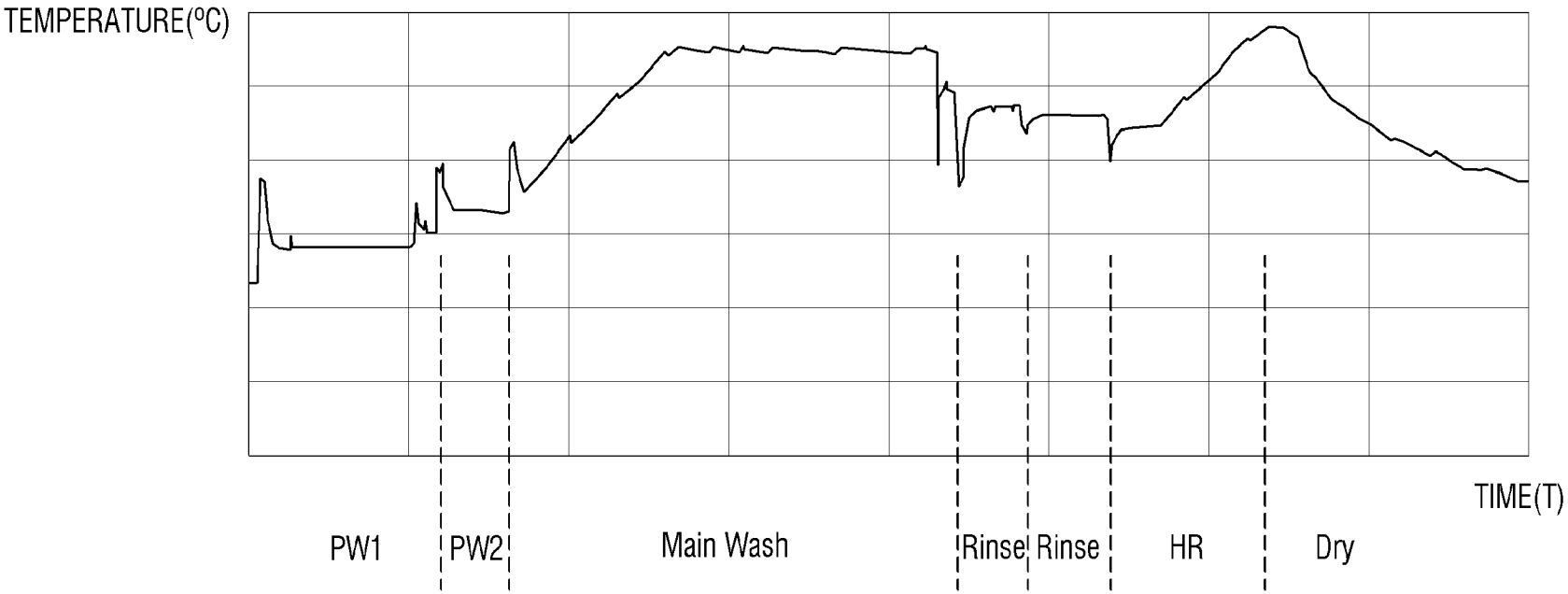
FIG. 9 is a view illustrating a wash process cycle of a dish washer according to the related art.

FIG. 9 is a view illustrating a wash process cycle of a dish washer according to the related art. Referring to FIG. 9, generally, a wash process (wash and rinse process) of the dish washer is divided into a main process and a preliminary process and repeatedly performed depending on the course, and hot wash water is used in the last rinse process.

For example, after pre-wash processes PW1 and PW2, a main wash process Main Wash is performed. Next, after a rinse process Rinse, a hot rinse process HR, and a dry process may be sequentially performed.

In the dish washer according to the related art, in order to allow a temperature of the wash water to reach a target temperature when the last rinse process is terminated, after a predetermined time of starting the last rinse process, the wash water is heated by operating a heater. When the rinse process is completed, the drying process is started. According to the related art, the dry process is performed for a long period of time by a method of driving a fan installed in a body to forcedly exhaust wet-steam in a wash tank.

As another example of the dry process, evaporation of water stained on dishes at the time of washing and rinsing the dishes is promoted by using hot water at the time of washing and rinsing the dishes and increasing a temperature in the dish washer, or the evaporated water vapor is condensed in a dry (or heat-exchange) duct or removed using an adsorbent. Alternatively, condensation by the dry (or heat-exchange) duct and the adsorbent are simultaneously used.

In the dish washer according to the related art described above, there was a problem in that a time consumed for washing dishes was increased due to a long dry time of generally 30 minutes or more, and thus, energy consumed in the dry process was increased. Further, in some methods, dry efficiency was significantly decreased, and a dry state was not good.

Figure 10:
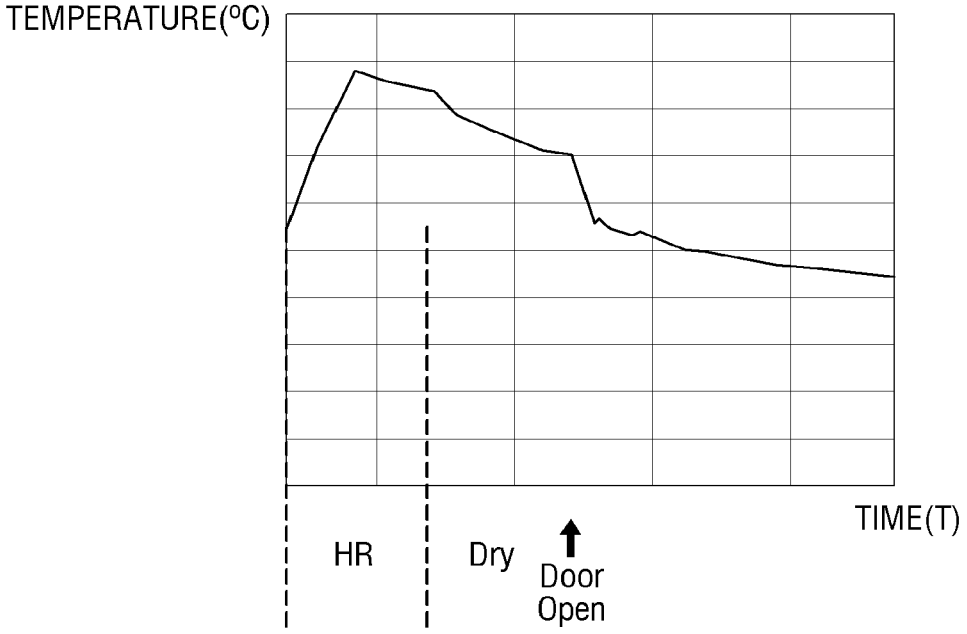
FIG. 10 is a view illustrating a wash process cycle of the dish washer according to the exemplary embodiment of the present disclosure.

FIG. 10 is a view illustrating a wash process cycle of the dish washer according to the exemplary embodiment of the present disclosure. Referring to FIG. 10, in the dish washer 10, when a wash process is completed, a dry process is performed. Before a dry process, the wash process and the rinse process may be performed in advance. Next, since a hot rinse process HR is performed in the last rinse step, dry is performed by latent heat for a predetermined time under a high temperature internal atmosphere, and the door 30 is opened by the automatic door opening device by the preset angle.

In this case, the blower fan 110 is driven, such that internal air is sprayed through the outlet 130 formed in the blower duct 120. That is, in the case in which high-temperature and high-humidity wet steam in the wash tank 60 is discharged upwardly through the door 30, an air curtain is formed by air flowing to the front. Therefore, it is possible to prevent the wet steam from flowing upwardly and block foreign materials (dust, and the like) introduced from the outside from being introduced into the wash tank again in advance.

Driving of the blower fan 110 may be controlled by a control device (not illustrated) separately connected thereto. A driving timing of the blower fan 110 is not limited to a time when the door 30 is opened. For example, the blower fan 110 may be immediately driven in the dry process.

As another example, the blower fan 110 may be driven before the door 30 is opened by the automatic door opening device 40 after the dry process is started. In this case, since the blower fan 110 may suck and discharge humid air in the wash tank 60 together, discharged through the air brake 50, there is an advantage in that moisture in the air brake 50 may be easily removed.

In addition, unlike the existing dish washer in which the dry time of about 40 minutes is required, wet-steam in the wash tank 60 may be rapidly discharged by implementing the air blower 100, such that efficiency may be improved by decreasing the dry time within at most 5 minutes or less.

That is, the air blower 100 described through the exemplary embodiments of the present disclosure may block wet-steam discharged at the time of opening the door 30 for decreasing the dry time of the dish washer 10 from being discharged upwardly. Particularly, the built-in type dish washer 10 embedded in a separate space to thereby be used may minimize damages to electric home appliances and wooden furniture positioned above the dish washer 10 caused by hot steam.

Further, in the case in which the blower fan 110 is provide at one side of the automatic door opening device 40, since the blower fan 110 may be driven by applying a current through the same power line as that of an actuator (not illustrated), there is no need to configure a separate power control device. In addition, the air blower 100 is provided between the body 20 and the wash tank 60, such that a change in structure of the dish washer 10 may be minimized.

Hereinabove, although various exemplary embodiments of the present disclosure has been individually described, respectively, it is not necessary to implement each of the exemplary embodiments alone, but the configuration and operation in each of the exemplary embodiments may be implemented in combination with at least one of other exemplary embodiment.

In addition, hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A dish washer comprising:

a body;

a wash tank provided in the body in order to wash dishes therein, the wash tank having an opening formed in a front surface of the wash tank;

a door rotatably coupled to a bottom end of a front surface of the body to open and close the wash tank;

an air blower positioned between an exterior of the wash tank and an interior of the body, the air blower including:

a blower duct, an outlet positioned on one end of the blower duct and facing the opening, a fan positioned inside the blower duct, and a partition wall provided in the blower duct, partitioning the outlet into a plurality of regions, wherein the air blower is configured to spray out an air jet forward from a front surface of the body to the front of the body so as to allow wet steam in the wash tank to forcedly flow to the front when the door is opened, wherein the blower duct includes:

a main channel communicating with the blower fan and positioned in parallel with a width direction of the door;

a first channel branched from the main channel and communicating with a first outlet positioned at one side of an automatic door opening device; and a second channel branched from the main channel and communicating with a second outlet positioned at the other side of the automatic door opening device.

2. The dish washer as claimed in claim 1, wherein the fan is positioned to be closer to the first channel than the second channel, and the main channel has a rear surface positioned to be inclined downward so that the second channel is close to the front.

3. The dish washer as claimed in claim 2, wherein the blower duct further includes a channel guide wall installed in each of the channels to guide a flow of the air flowing through the fan.

4. The dish washer as claimed in claim 3, wherein the channel guide wall includes:

a first channel guide wall installed in the main channel to be positioned in parallel with the rear surface of the blower duct; and a second channel guide wall installed in the first channel and positioned to be perpendicular to the first channel guide wall.

5. The dish washer as claimed in claim 4, wherein the channel guide wall further includes a third channel guide wall installed in a boundary between the main channel and the second channel or the inside of the second channel and positioned to be parallel with the second channel guide wall.

6. The dish washer as claimed in claim 1, wherein the fan is provided between an upper exterior of the wash tank and the interior of the body to thereby be positioned at one side surface of the body.

7. The dish washer as claimed in claim 1, wherein the body has a communication hole communicating with the exterior on one side surface, and the fan sucks external air from the communication hole to discharge the sucked air to the blower duct.

8. The dish washer as claimed in claim 7, wherein the fan is any one of a centrifugal fan, an axial flow fan, and a cross flow fan.

9. The dish washer as claimed in claim 1, further comprising an automatic door opening device automatically opening the door after a wash process is terminated, wherein the automatic door opening device is positioned between an upper portion of the exterior of the wash tank and the interior of the body, and the outlet is positioned at both sides of the automatic door opening device, respectively.

10. The dish washer as claimed in claim 1, further comprising an automatic door opening device automatically opening the door after a wash process is terminated, wherein the automatic door opening device is positioned between an upper portion of the exterior of the wash tank and the interior of the body, and the blower duct is positioned above the automatic door opening device.

11. The dish washer as claimed in claim 1, wherein the blower duct has a channel in which air flows, the channel being provided to be inclined upwardly toward the outlet.

12. The dish washer as claimed in claim 1, wherein the air blower is installed in plural, and each of the air blowers is positioned between an upper portion of the exterior of the wash tank and the interior of the body.

13. The dish washer as claimed in claim 1, wherein the air jet is sprayed out at a speed faster than a natural discharge speed of air in the wash tank.

14. An air blower to blow wet steam discharged between a body of a dish washer and a door of the dish washer when a wash process of the dish washer is terminated and the door of the dish washer is opened by an automatic door opening device, the air blower comprising:

a blower duct positioned at an upper portion of the body of the dish washer;

an outlet positioned on one end of the blower duct and facing the door of the dish washer;

a fan positioned inside the blower duct; and a partition wall provided in the blower duct, partitioning the outlet into a plurality of regions, wherein the air blower is positioned in an interior of the body of the dish washer, wherein the blower duct includes:

a main channel communicating with the fan and positioned in parallel with a width direction of the door;

a first channel branched from the main channel and communicating with a first outlet positioned at one side of the automatic door opening device; and a second channel branched from the main channel and communicating with a second outlet positioned at the other side of the automatic door opening device.

15. The air blower as claimed in claim 14, wherein the blower duct further includes a channel guide wall installed in each of the channels to guide a flow of air flowing through the fan.

* * * * *